US007944097B2

(12) United States Patent
Rimbrecht et al.

(10) Patent No.: US 7,944,097 B2
(45) Date of Patent: May 17, 2011

(54) DRIVE MECHANISM FOR A MAIL SORTING SORTING MACHINE, OR METHOD FOR ASSEMBLING A DRIVE MECHANISM FOR A MAIL SORTING SORTING MACHINE

(75) Inventors: Andreas Rimbrecht, Blumberg (DE); Ernst Bauer, Messkirch (DE); Jens Preetz, Owingen (DE)

(73) Assignee: Kendrion Magnettechnik GmbH, Donaueschingen (DE)

( * ) Notice: Subject to any disclaimer, the term of this patent is extended or adjusted under 35 U.S.C. 154(b) by 35 days.

(21) Appl. No.: 12/232,779

(22) Filed: Sep. 24, 2008

(65) Prior Publication Data

US 2009/0091197 A1 Apr. 9, 2009

(30) Foreign Application Priority Data

Oct. 2, 2007 (DE) ..... 10 2007 047 308

(51) Int. Cl.
*H02K 33/18* (2006.01)

(52) U.S. Cl. ..... 310/38; 310/67 R

(58) Field of Classification Search ..... 310/38, 310/37, 64, 67 R

See application file for complete search history.

(56) References Cited

U.S. PATENT DOCUMENTS

| | | | | |
|---|---|---|---|---|
| 4,899,073 | A * | 2/1990 | Takeuchi et al. | 310/116 |
| 6,756,871 | B1 * | 6/2004 | Suzuki et al. | 335/229 |
| 2003/0164648 | A1 * | 9/2003 | Byram | 310/36 |
| 2007/0252451 | A1 * | 11/2007 | Shibuya et al. | 310/64 |

FOREIGN PATENT DOCUMENTS

| | | | |
|---|---|---|---|
| DE | 26 13 038 | A1 | 10/1976 |
| DE | 27 20 053 | A1 | 12/1977 |

* cited by examiner

*Primary Examiner* — Quyen Leung
*Assistant Examiner* — Leda Pham
(74) *Attorney, Agent, or Firm* — The Nath Law Group; Jerald L. Meyer; Jiaxiao Zhang

(57) ABSTRACT

The claimed subject matter relates to a mechanism and method for assembling a drive mechanism for a mail sorting machine, or to a drive mechanism for a sorting gate of a mail sorting machine, used to deflect flat, flexible mail items during their conveyance through a mail sorting machine, comprising a base plate that has a bottom plate, a shaft, a bearing assembly for mounting the shaft on the base plate, a stator, which is firmly mounted on the base plate, and a rotor, which is rotatably mounted in the base plate so as to accommodate the shaft and rotate the shaft, wherein the bearing assembly, the rotor, the stator, preferably at least one stop surface for a stop on the rotor, and preferably also a heat dissipation assembly for the stator are all arranged on the base plate.

10 Claims, 2 Drawing Sheets

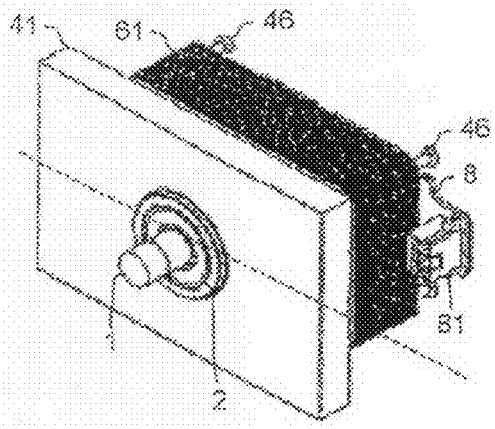
Fig. 2
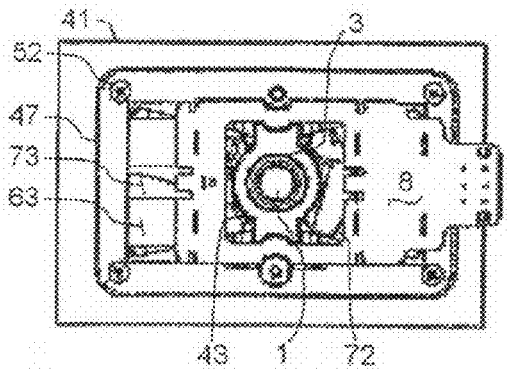
Fig. 3
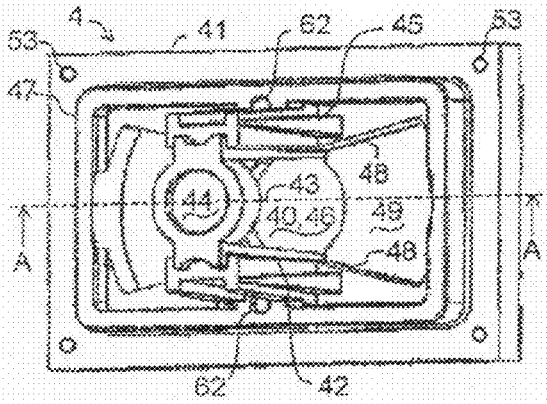
Fig. 4
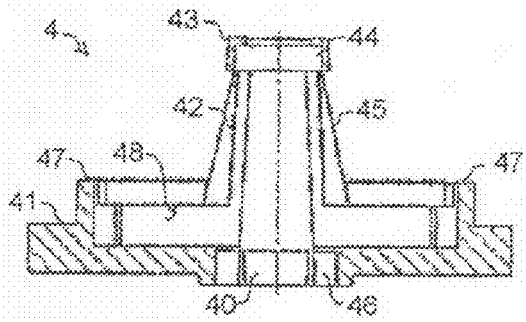
Fig. 5 (A-A)
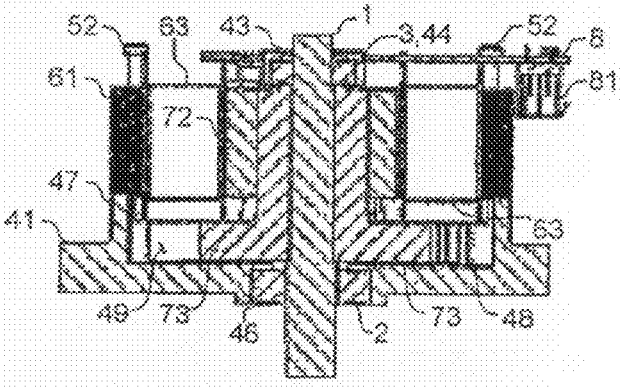
Fig. 6 (A-A)

DRIVE MECHANISM FOR A MAIL SORTING SORTING MACHINE, OR METHOD FOR ASSEMBLING A DRIVE MECHANISM FOR A MAIL SORTING SORTING MACHINE

BACKGROUND

The claimed subject matter relates to a drive mechanism for a mail sorting machine, or to a method for assembling a drive mechanism for a mail sorting machine of this type.

EP 11 33 444 B1 describes a mail sorting sorting machine, which has sorting gates in conveying paths, over which letters, as flat, flexible mail items, are distributed from an intake point to a plurality of outlet points. For activating such sorting gates, a drive mechanism for mail sorting sorting machines is assigned to each sorting gate.

Mail sorting sorting machines of this type customarily have a plurality of individual components, arranged separately from one another, which make up such a mail sorting sorting machine drive mechanism. The individual components comprise especially some type of base plate or frame, on which the other components are arranged, in some cases separately and in some cases as preassembled units. In particular, such an arrangement comprises a shaft, which is guided through a rotor, wherein the rotor is arranged in a stator, in a known manner, and can be rotated in relation to the stator by means of coils arranged in the stator. With the rotation of the rotor, the shaft is correspondingly rotated together with the rotor. Such an arrangement comprised of rotor, stator and shaft is mounted on the base plate as individual components. Also known is the process of arranging heat dissipating devices in the area of the stator, in order to draw off heat generated by the coils or by a sheet packet encompassing the coils of the stator.

SUMMARY

Certain exemplary embodiments of the claimed subject matter disclose configuring a drive mechanism for a sorting gate of a mail sorting machine, used to deflect flat, flexible mail items, in such a way as to enable a simple assembly of the individual components and a compact and space-saving final emplacement of the components following their assembly.

This object is attained in certain exemplary embodiments with a drive mechanism for a mail item sorting machine, or with a method for assembling a drive mechanism for a mail item sorting machine. Advantageous embodiments are disclosed in the exemplary embodiments described below.

Accordingly, a drive mechanism for a sorting gate of a mail sorting sorting machine, used to deflect flat, flexible mail items, especially letters, during their transport through a mail sorting sorting machine is preferred. The drive mechanism is equipped with a base plate having a bottom plate, a shaft, a bearing assembly for mounting the shaft on the base plate, a stator, which is securely fastened to the base plate, and a rotor, which is rotatably mounted in the base plate for the purpose of accommodating the shaft and rotating the shaft. According to a first, preferred embodiment, the bearing assembly, the rotor and the stator are all arranged on the base plate. According to a second preferred embodiment, at least one stop surface for a stop on the rotor and a heat dissipating assembly for the stator are all also arranged on the base plate.

Preferred is such a device with a first bearing in the bottom of the base plate for mounting the shaft, and additionally with a location opening in the bottom of the base plate, which can also be configured as a recess, which extends transversely to the extension of the shaft, wherein the location opening has at least the stop surface, which is arranged as a wall section of the base plate, for limiting a path of the stop, which is structured or rotatably arranged on the rotor, during the rotation of the rotor in the direction of rotation of the stop. The base plate thereby assumes multiple structural functions as a support for the rotor and at the same time as a counter stop for limiting a permitted angle of rotation of the rotor.

The base plate is preferably equipped with mounting elements for mounting the stator, and with a cover, such that the stator is arranged between the base plate and the cover, and an area to the side of the stator between the base plate and the cover is configured without walls, for the purpose of drawing off heat generated in the stator. In this manner, the base plate also assumes a structural function as a heat dissipation element for drawing off heat that is generated by coils and sheets customarily arranged in the stator.

The base plate preferably has a connection dome for mounting the shaft, wherein the connection dome extends to the side of and above a first bearing, which is held in the bottom of the base plate, and the shaft, and has a bearing seat for a second bearing for mounting the shaft. Therefore, in a single component, which can be produced, for example, as a single piece via injection molding, in addition to the other listed components, two bearings, spaced from one another, can be arranged for mounting the shaft without pivoting in relation to the shaft axis of the shaft. In this, the connection dome is preferably open in configuration between the bearing seat and the bottom, toward at least one side, transversely to the longitudinal extension of the shaft, to allow installation of the rotor. The rotor can thereby be installed in a simple manner between the two bearings from the side.

The connection dome preferably extends through the stator. In particular, the connection dome has ribs, extending axially parallel in relation to the shaft, in the direction facing away from the shaft and toward the stator. This arrangement of the ribs provides stability, so that the ribs act as strengthening ribs.

Through connecting surfaces between the base plate and the stator, which exist in such an arrangement, and on which the stator rests, the base plate also acquires a heat dissipating function.

Accordingly, a method for assembling a drive mechanism for a mail item sorting sorting machine of this type is preferred, in which, in an early process step, a rotor is installed on a base plate with a connection dome, which extends to the side of and above a base plate opening formed in a bottom of the base plate, and which is open in configuration on one side, transversely to the longitudinal extension of a shaft. In a later process step, after the rotor has been installed, a stator is placed on the base plate, enclosing the connection dome. In a further step, after the rotor has been installed, and after or before the stator has been emplaced, the shaft is then inserted, non-rotatably connected to the rotor, through a first bearing in the base plate opening, through the rotor, which is arranged at least partially in the connection dome, and through a second bearing, which is configured in the connection dome on the far side of the rotor from the standpoint of the first bearing. Whereas the first bearing can optimally be installed in the bottom of the base plate together with the shaft, the second bearing is installed in the connection dome, preferably before the rotor is installed.

BRIEF DESCRIPTION OF THE DRAWING

In what follows, an exemplary embodiment will be specified in greater detail with reference to the set of drawings. These show, in:

FIG. 2 the drive mechanism for a mail sorting sorting machine in its nearly assembled state, from a perspective, side view;

FIG. 3 a side view of the assembly of FIG. 2, of the end surface of a connection dome protruding from a base plate;

FIG. 4 a perspective view of the base plate with the connection dome protruding from it;

FIG. 5 a sectional view of the base plate and part of the connection dome of the base plate, and FIG. 6 the sectional view according to FIG. 5, wherein sections of a rotor and a shaft are also shown installed therein.

DETAILED DESCRIPTION

Figure 1:
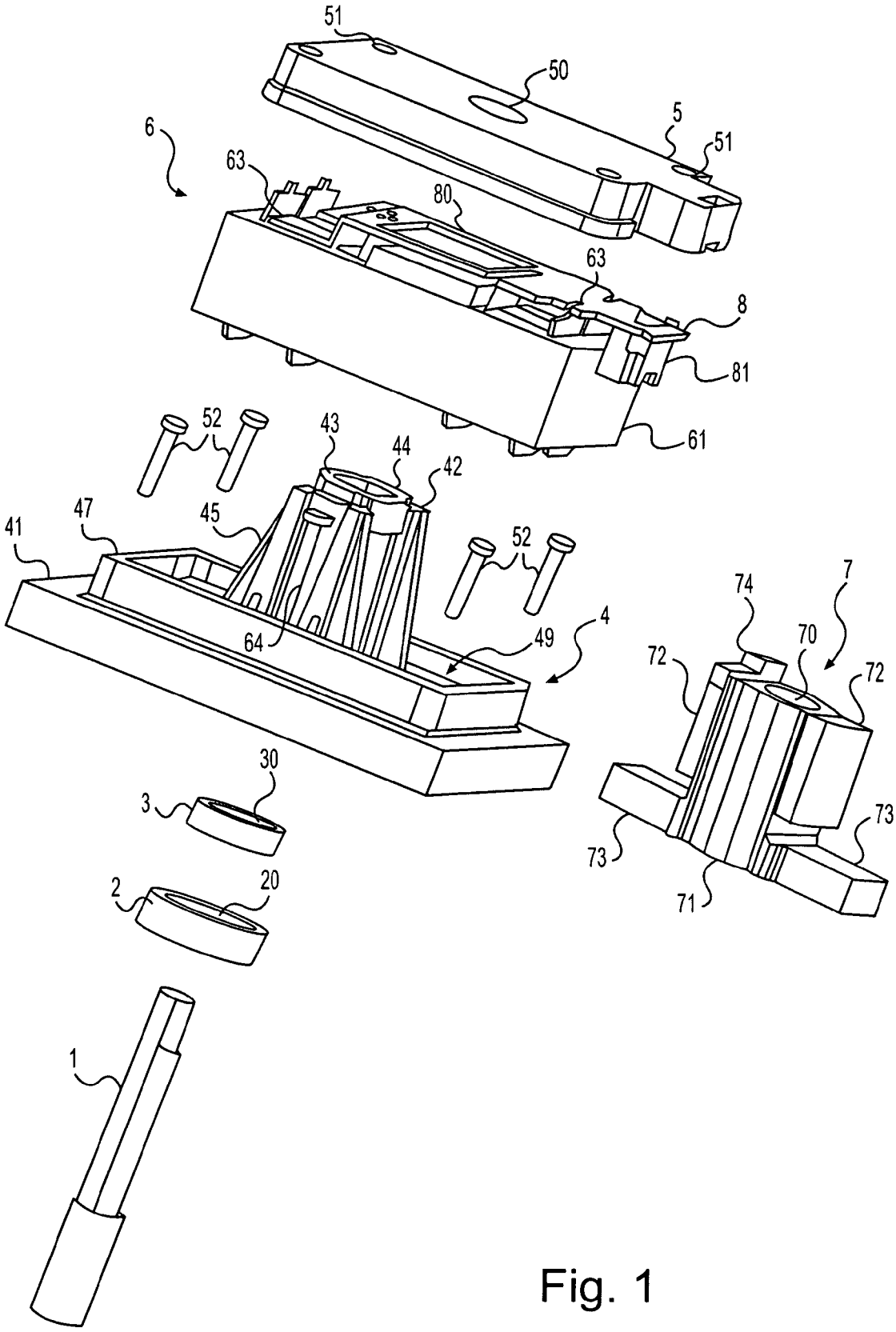
FIG. 1 components of a drive mechanism for a mail sorting sorting machine, in an exploded view, prior to assembly.

As is apparent from the figures, especially from FIG. 1, a shaft 1 can be arranged, rotatably mounted, in a base plate 4 via a first bearing 2 and a second bearing 3. In this, the first bearing 2 can be installed in a base plate opening 40 on the bottom side, or in a bearing seat 46 as a bearing location opening for the first bearing. The second bearing 3 can be installed in a bearing seat 43, spaced in the axial direction of the shaft from the first bearing 2 and a bottom 41 of the base plate 4, in which the first bearing 2 is installed. The bearing seat 43 of the second bearing 2 is formed by a front end of a connection dome 42. Once the shaft 1 has been inserted, it is therefore mounted in the base plate 4, inserted directly through corresponding bearing openings 20, 30 in the first or the second bearing 2, 3, respectively.

Before the shaft 1 is inserted into the base plate 4 or into the bearing 2, 3, a rotor 7 is arranged in or on the base plate 4. The rotor 7 has a rotor opening 70, which leads centrally through a rotor center section 71, and through which the shaft 1 is conducted during assembly. The rotor opening 70 has an out-of-round cross-section, which is adapted to match a corresponding outer circumference of the shaft 1 in this area of the shaft 1, so that a rotation of the rotor 7 is transferred directly to the shaft 1, causing the shaft 1 to rotate together with the rotor 7.

To allow the rotor 7 to be installed between the first bearing 2 and the second bearing 3, the connection dome 42 is preferably comprised of two or more walls, which extend from the bottom 41 of the base plate 4 to the bearing seat 43, wherein on at least one side, preferably on two opposite sides of the connection dome 42, no wall is provided. In this manner, the rotor 7 can be inserted between the first bearing 2 and the second bearing 3 from a lateral direction through the open section of the connection dome 42. With a subsequent insertion of the shaft 1 through the bearing openings 20, 30 of the two bearings 2, 3 and the rotor opening 70 that lies between them, the rotor 7 is mounted in the base plate 4 in a fixed position but capable of rotating together with the shaft 1 around its shaft axis.

To be able to drive the rotor 7, in interaction with a stator 6, to rotate around the shaft 1, a permanent magnet or a plurality of permanent magnets 72 are arranged to the sides of the rotor center section 71, in other words especially axially parallel to the shaft 1 on the rotor center section 71. The preferably two permanent magnets 72 extend in the direction of the recesses or wall-free sections of the connection dome 42 and, if applicable, at the sides, to the outside of the connection dome 42. In this case, the permanent magnets 72 are narrow in configuration in relation to the width of the wall-free section of the connection dome 42, so that they enable sufficient rotation of the rotor 7 within a desired and necessary rotational range.

To limit a range of rotation of the rotor 7, one or preferably two stops 73 are formed on it, preferably on its underside, in other words on the side that faces the bottom 41. In this case, the stops 73 extend from the lower rotor center section 71 in a lateral direction, i.e., preferably in the same direction as the permanent magnets 72 arranged above this. To form a counter stop for the stops 73, location openings 49 are formed in the base plate 4, especially in the bottom 41 of the base plate 4. In the illustrated embodiment, the location openings 49 are formed by recesses in the wall material of the base 41, wherein the location openings 49 extend out of the region below the connection dome 42 in a lateral direction, over the wall-free area of the connection dome 42. In this, the wall surfaces of the location opening 49, which are lateral in the direction of rotation, form stop surfaces 48 for the stop or stops 73. Preferably, rubber stops can be arranged on the stop surfaces 48, which produce a cushioning effect when the corresponding stop 73 is struck. The rotor 7 can therefore be rotated only within a rotational range which is defined by the stops 73 and the stop surfaces 48 of the location openings 49.

To mount the stator 6 and align it in the proper position, the base plate 4 has a preferably continuous mounting projection 47. Preferably, from a plan view, the shape of the mounting projection 47 is rectangular, in other words it is configured to correspond to the shape of the stator 6. The actual fastening of the stator 6 on the base plate 4 is preferably accomplished using stator screws, which are conducted through the stator 6 or sheet plates of the stator 6, and are screwed into the base plate 41 in corresponding connection threading 62 (FIG. 4).

The stator 6 is comprised, in a known manner, of a component that guides a magnetic field, such as a sheet packet 61, for example, which encompasses coils 63. By activating the coils 63 by applying an appropriate current flow, the coils 63 generate a magnetic field, which travels over sheet plates in the sheet packet 61, in interaction with the permanent magnets 72 of the rotor 7, and causes a pivoting of the rotor 7 in correspondence with the applied current flow.

For contacting, a printed circuit board 8 with corresponding electronic components is preferably used. Preferably, the printed circuit board 8 is arranged on the stator 6 on a surface or parallel to the surface of the sheet packet 61. The printed circuit board 8 preferably has a plug assembly 81, which is used to connect it to an external power supply and/or control device. Especially, the printed circuit board 8 has components that are suitable or necessary for control. These components preferably include a sensor for detecting an instantaneous rotational position of the rotor 7. Preferably, the rotor 7 correspondingly has a sensing element 74, which is arranged on the side of the rotor 7 which faces the printed circuit board 8. In the represented embodiment, the sensing element 74 is arranged above one of the permanent magnets 72. The sensing element 74 and the sensor that communicates with it can be structured in a known manner, and can especially be configured as optical, magnetic or mechanical switching elements.

The connection dome 42 preferably has ribs 45 on its exterior surface, in other words on its side that faces away from the shaft 1 and the rotor 7. The ribs 45 are configured especially as strengthening ribs, and extend from the bottom 41 to the bearing seat 43, with their width and depth decreasing along the wall area of the connection dome 42. Preferably, the ribs 45 not only provide reinforcement as strengthening ribs, but also perform a heat dissipating function, as the ribs 45 create a defined spacing between the outer circumference of the connection dome 42 and the inner circumference of a stator opening 60 that leads through the stator 6.

The stator opening 60 is configured as a through opening in an axis-encompassing and axially parallel direction in relation to the shaft 1, and is dimensioned in such a way that when the stator 6 is placed over the connection dome 42, the connection dome is enclosed. Additionally, the dimensioning is such that, if applicable, sections of the rotor 7 that extend laterally out of the connection dome 42 remain freely movable. If the printed circuit board 8 extends in the area axially above the stator 6, the printed circuit board 8 also has a correspondingly dimensioned printed circuit board opening 80, which is at least sufficiently large in dimension to encompass the bearing seat 43.

To protect the components attached to the base plate 4, a cover 5 is preferably fastened to the base plate 4, opposite the bottom 41 of the base plate 4. In this case, lateral circumferential walls of the cover 5 extend only so far in the direction of the base plate 4 or from its bottom 41, that to the side of the sheet packet 61 a wall-free space remains, and preferably also a free flow connection to the area between the connection dome 42 and the interior side of the stator 6, to be able to draw heat off from the stator 6. Preferably, a central cover opening 50 is formed in the cover 5, through which, if applicable, an end section or continuous section of the shaft 1 can be conducted. To attach the cover 5, cover screws 52 are preferably used, which are inserted through openings 51 formed in the corner areas, and are screwed into corresponding threading in the bottom 41 of the base plate 4 (FIG. 3). Naturally, the attachment can also be accomplished differently, for example using latching tongues rather than screw connections.

LIST OF REFERENCE SYMBOLS

1 Shaft
2 First bearing
20 Bearing opening in 2
3 Second bearing
30 Bearing opening in 3
4 Base plate
40 Base plate opening on the bottom side
41 Bottom
42 Connection dome for connecting 41 and 43
43 Bearing seat for 3
44 Bearing location opening in 43
45 Ribs, especially strengthening ribs
46 Bearing seat/bearing location opening for 2
47 Mounting projection for 73
48 Stop surface for 73
49 Location opening for 73
5 Cover
50 Cover opening for 1
51 Opening for cover screws
52 Cover screws
53 Attachment threading for cover screws
6 Stator
60 Stator opening for 1
61 Sheet packet
62 Attachment threading for 64
63 Coils
64 Stator screws
7 Rotor
70 Rotor opening for 1
71 Rotor center section
72 Permanent magnets
73 Stop
74 Sensing element
8 Printed circuit board
80 Printed circuit board opening for 1
81 Connecting plug

The invention claimed is:

1. A drive mechanism for a sorting gate of a mail sorting machine, used to deflect flat, flexible mail items as they are transported through a mail sorting machine, comprising:

a single piece base plate that has a bottom plate;

a shaft;

a bearing assembly for mounting the shaft on the single piece base plate;

a stator, which is permanently fastened to the single piece base plate;

a rotor, which is rotatably mounted in the single piece base plate so as to accommodate the shaft and rotate the shaft;

a location opening which extends transversely to the extension of the shaft in the bottom of the single piece base plate; and a connection dome on the single piece base plate for mounting the shaft, wherein the connection dome extends to a side of and above a first bearing, which is held in the bottom of the single piece base plate in a first bearing seat, and has a second bearing seat for a second bearing for mounting the shaft, characterized in that the bearing assembly, the rotor and the stator are all arranged on the single piece base plate, or the bearing assembly, the rotor, the stator, at least one stop surface for a stop on the rotor, and a heat dissipation assembly for the stator are all arranged on the single piece base plate, and wherein the location opening has at least one stop surface, which is arranged as a wall section of the single piece base plate for the purpose of limiting a path of travel of at least one stop, which is formed or non-rotatably arranged on the rotor, during rotation of the rotor in the direction of rotation of the at least one stop.

2. A drive mechanism for a sorting gate of a mail sorting machine, used to deflect flat, flexible mail items as they are transported through a mail sorting machine, comprising:

a single piece base plate that has a bottom plate;

a shaft;

a bearing assembly for mounting the shaft on the single piece base plate;

a stator, which is permanently fastened to the single piece base plate;

mounting elements for attaching the stator to the single piece base plate;

a rotor, which is rotatably mounted in the single piece base plate so as to accommodate the shaft and rotate the shaft;

a connection dome on the single piece base plate for mounting the shaft, wherein the connection dome extends to a side of and above a first bearing, which is held in the bottom of the single piece base plate in a first bearing seat, and has a second bearing seat for a second bearing for mounting the shaft; and a cover, characterized in that the bearing assembly, the rotor and the stator are all arranged on the single piece base plate, or the bearing assembly, the rotor, the stator, at least one stop surface for a stop on the rotor, and a heat dissipation assembly for the stator are all arranged on the single piece base plate, and wherein the stator is arranged between the single piece base plate and the cover, and an area to the side of the stator between the single piece base plate and the cover is configured without walls, so as to draw off heat that is generated in the stator.

3. A drive mechanism for a sorting gate of a mail sorting machine, used to deflect flat, flexible mail items as they are transported through a mail sorting machine, comprising:

a single piece base plate that has a bottom plate;

a shaft;

a bearing assembly for mounting the shaft on the single piece base plate;

a stator, which is permanently fastened to the single piece base plate;

mounting elements for attaching the stator to the single piece base plate;

a rotor, which is rotatably mounted in the single piece base plate so as to accommodate the shaft and rotate the shaft;

a connection dome on the single piece base plate for mounting the shaft, wherein the connection dome extends to a side of and above a first bearing, which is held in the bottom of the single piece base plate in a first bearing seat, and has a second bearing seat for a second bearing for mounting the shaft, characterized in that the bearing assembly, the rotor and the stator are all arranged on the single piece base plate, or the bearing assembly, the rotor, the stator, at least one stop surface for a stop on the rotor, and a heat dissipation assembly for the stator are all arranged on the single piece base plate, and wherein the connection dome is configured to be open on at least one side between the second bearing seat and the bottom, transversely to the longitudinal extension of the shaft, to allow insertion of the rotor.

4. The drive mechanism according to claim 1, wherein the connection dome extends all the way through the stator.

5. A drive mechanism for a sorting gate of a mail sorting machine, used to deflect flat, flexible mail items as they are transported through a mail sorting machine, comprising:

a single piece base plate that has a bottom plate;

a shaft;

a bearing assembly for mounting the shaft on the single piece base plate;

a stator, which is permanently fastened to the single piece base plate;

a rotor, which is rotatably mounted in the single piece base plate so as to accommodate the shaft and rotate the shaft; and a connection dome on the single piece base plate for mounting the shaft, wherein the connection dome extends to a side of and above a first bearing, which is held in the bottom of the single piece base plate in a first bearing seat, and has a second bearing seat for a second bearing for mounting the shaft, characterized in that the bearing assembly, the rotor and the stator are all arranged on the single piece base plate, or the bearing assembly, the rotor, the stator, at least one stop surface for a stop on the rotor, and a heat dissipation assembly for the stator are all arranged on the single piece base plate, and wherein the connection dome has ribs that extend axially parallel in relation to the shaft, in a direction that faces away from the shaft and toward the stator.

6. The drive mechanism according to claim 5, wherein, in the assembled state, between the connection dome and the stator that is placed around it, open spaces are formed between the ribs in at least one direction that extends axially parallel in relation to the shaft.

7. A method of assembling a drive mechanism for a sorting gate of a mail sorting machine, used to deflect flat, flexible mail items, comprising:

installing a rotor on a single piece base plate with a connection dome, which extends to the side of and above a single piece base plate opening configured in a bottom of the single piece base plate, and which is configured to be open on one side, transversely to the longitudinal extension of a shaft;

installing, after the rotor has been installed, a stator on the single piece base plate, enclosing the connection dome; and after the rotor and/or the stator has been installed, inserting the shaft and non-rotatably connecting the shaft to the rotor, through a first bearing in a first bearing seat in the single piece base plate opening, through the rotor, which is at least partially arranged in the connection dome, and through a second bearing in a second bearing seat, which is formed in the connection dome on the far side of the rotor from the standpoint of the first bearing.

8. The drive mechanism according to claim 2, wherein the connection dome extends all the way through the stator.

9. The drive mechanism according to claim 3, wherein the connection dome extends all the way through the stator.

10. The drive mechanism according to claim 5, wherein the connection dome extends all the way through the stator.

* * * * *